US005187318A

United States Patent [19]

Sanderson et al.

[11] Patent Number: 5,187,318

[45] Date of Patent: * Feb. 16, 1993

[54] AIRCRAFT ARMAMENT MOUNTING APPARATUS

[76] Inventors: Paul H. Sanderson, 2019 Cripple Creek, Lewisville, Tex. 75067; Richard C. Serkland, 1010 Meadowlake Dr., McKinney, Tex. 75069

[ * ] Notice: The portion of the term of this patent subsequent to Jun. 18, 2008 has been disclaimed.

[21] Appl. No.: 614,504

[22] Filed: Nov. 16, 1990

Related U.S. Application Data

[63] Continuation-in-part of Ser. No. 532,172, Jun. 4, 1990, Pat. No. 5,024,138.

[51] Int. Cl.[5] ..... F41A 23/00

[52] U.S. Cl. ..... 89/37.22; 89/1.54

[58] Field of Search ..... 89/1.54, 1.51, 37.16, 89/37.17, 37.19, 37.21, 37.22, 37.03, 36.11, 1.58, 1.59, 1.53

[56] References Cited

U.S. PATENT DOCUMENTS

| | | | |
|---|---|---|---|
| 2,371,324 | 3/1945 | Trotter | 89/37.03 |
| 2,398,871 | 4/1946 | Turnbull et al. | 89/37.16 |
| 2,493,945 | 1/1950 | Cocks et al. | 89/37.19 |
| 2,709,947 | 6/1955 | Woods | 89/1.7 |
| 3,967,528 | 7/1976 | Baker | 89/1.53 |
| 4,233,883 | 11/1980 | Miko | 89/1.53 |
| 4,395,003 | 7/1983 | Coutin | 89/1.53 |
| 4,429,611 | 2/1984 | Oldham et al. | 89/1.816 |
| 4,587,881 | 5/1986 | Clayson et al. | 89/37.16 |
| 4,620,680 | 11/1986 | Hasquenoph et al. | 89/1.53 |
| 5,024,138 | 6/1991 | Sanderson et al. | 89/37.22 |

FOREIGN PATENT DOCUMENTS

| | | | |
|---|---|---|---|
| 1065003 | 5/1954 | France | 89/1.54 |

OTHER PUBLICATIONS

General Electric, 20/30-mm Flexible Weapon System, Jul. 1971.

General Electric, XM-35 20-mm Armament Subsystem, Sep. 1969.

Hughes Gun Systems Brochure, Sep. 1969.

*Primary Examiner*—Stephen Johnson

*Attorney, Agent, or Firm*—Konneker & Bush

[57] ABSTRACT

An aircraft armament mounting system includes an elongated support plank member which is longitudinally insertable transversely through the aircraft cabin area so that a central portion is disposed therein. The central plank portion is anchored within the cabin area, with opposite outer longitudinal portions of the plank projecting outwardly from opposite sides of the aircraft. Specially designed mounting structures are provided which permit selectively variable and oriented combinations of rocket launchers, 7.62 mm machine guns and 0.50 caliber machine guns to be removably secured to the outwardly projecting plank portions to provide the aircraft with a high degree of armament interchangeability and versatility.

9 Claims, 5 Drawing Sheets

AIRCRAFT ARMAMENT MOUNTING APPARATUS

CROSS-REFERENCE TO RELATED APPLICATION

This application is a continuation-in-part of U.S. application Ser. No. 532,172, now U.S. Pat. No. 5,024,138 entitled "IMPROVED AIRCRAFT ARMAMENT APPARATUS", which was filed on Jun. 4, 1990 and is hereby incorporated herein by reference.

BACKGROUND OF THE INVENTION

The present invention relates generally to armament apparatus for aircraft and, in preferred embodiments thereof, more particularly provides a specially designed support structure for mounting on an aircraft various weaponry, and interchangeable combinations of such weaponry, including "mini" M-134 7.62 mm machine guns (commonly referred to as "mini" guns), .50 caliber machine guns, and multiple tube rocket launchers.

Disclosed in copending U.S. application Ser. No. 532,172 is a unique plank mounting structure which extends transversely through the rear cabin area of a helicopter, with a longitudinally central portion of the plank being secured within the cabin area, and opposite ends of the plank projecting outwardly beyond the opposite sides of the helicopter body. The outer ends of the plank project outwardly of the helicopter skids and have multiple tube rocket launchers mounted thereon via conventional bomb racks secured to the plank tips. Also mounted on opposite ends of the plank, inboard of the rocket launchers, are a pair of .50 caliber machine guns.

The plank mounting of the rocket launchers outboard of the helicopter skids facilitates the in-flight jettisoning of the launchers without causing the released launchers to strike the helicopter skids and be deflected therefrom against the helicopter body. However, in certain instances it is desirable to position a rocket launcher over, or even somewhat inboard of, a helicopter skid. Accordingly, it is an object of the present invention to provide, in conjunction with the aforementioned support plank structure, mounting apparatus for securing a rocket launching tube over a helicopter skid in a manner permitting the launcher to be jettisoned in flight without striking the skid.

In developing the present invention it has also been found desirable, in certain instances, to arm the helicopter with one or more 7.62 mm M-134 machine guns instead of the larger .50 caliber machine guns disclosed in copending U.S. application Ser. No. 532,172. It is accordingly a further object of the present invention to provide, in conjunction with the aforementioned support plank structure, mounting apparatus for arming a helicopter with one or more 7.62 mm machine guns.

It has also been recognized that, in conjunction with the plank support structure, it would be desirable to further improve the weapon interchangeability of the overall weaponry system. For example, it would be desirable to arm the aircraft with changeable weaponry combinations selected from the weapon group consisting of 7.62 mm machine guns, .50 caliber machine guns and rocket launchers. It is accordingly a further object of the present invention to provide the aforementioned support plank structure with weapon mounting apparatus permitting this improved weaponry interchangeability.

SUMMARY OF THE INVENTION

In carrying out principles of the present invention, in accordance with a preferred embodiment thereof, improved aircraft armament apparatus is provided which includes an elongated support plank, preferably of a rigid metal honeycomb construction, which is longitudinally insertable transversely through a rear cabin portion of the aircraft in a manner such that a longitudinally central portion of the plank is disposed within the cabin area, and outer end portions of the plank project outwardly from opposite sides of the aircraft. To hold the plank in place, means are provided for anchoring the central plank portion to the aircraft (which may be a helicopter or a fixed wing aircraft).

The improved aircraft armament apparatus also includes weaponry mounting means securable to the plank and operative to support thereon variably positionable and interchangeable weaponry combinations selected from the representative weapons group consisting of 7.62 mm machine guns, .50 caliber machine guns, and rocket launchers. In preferred embodiments thereof, the weaponry mounting means are operative to selectively:

1. Mount a rocket launcher, a 7.62 mm machine gun, or a .50 caliber machine gun on the outer end of either outwardly projecting plank section, or on the outer ends of both outwardly projecting plank sections; and/or
2. Mount a rocket launcher, a 7.62 mm machine gun, or a .50 caliber machine gun on an inboard portion of either outwardly projecting plank section, or on inboard portions of both outwardly projecting plank sections.

It can readily be seen that this weapon mounting versatility provides the plank-based armament support system with the ability to arm the aircraft with a large number of weaponry combinations and arrangements, which may be readily varied to suit the particular mission of the aircraft, such combinations including only rocket launchers, only 7.62 mm machine guns, only .50 caliber machine guns, and various combinations and positioned orientations of the three weapons on the plank.

According to a feature of the present invention, the weaponry mounting means include a specially designed, angled bomb ejector rack used to secure a rocket launcher to an inboard location on the underside of one of the outwardly projecting plank sections over the skid of a helicopter to which the plank is operatively mounted. The angled bomb ejector rack is operative to jettison the launcher at a downward and outward angle to prevent it from striking the skid.

BRIEF DESCRIPTION OF THE DRAWINGS

Other objects and features of the invention will become more readily apparent from the detailed description when read in conjunction with the accompanying drawings, in which.

DETAILED DESCRIPTION

Figure 1:
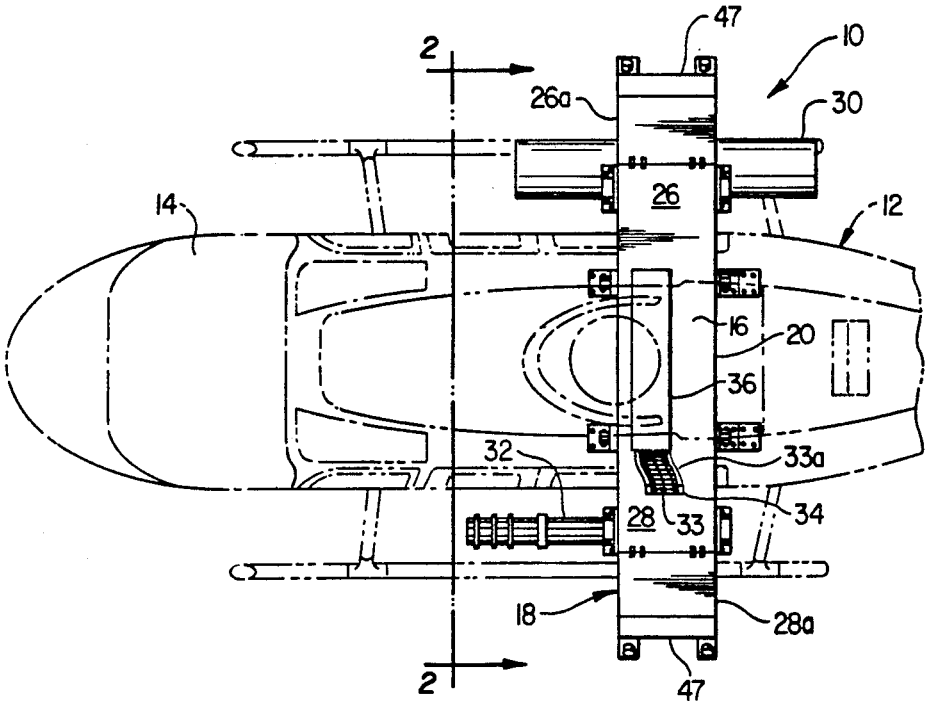
FIG. 1 is a partial top plan view, in phantom, of a representative helicopter to which is operatively secured improved armament apparatus of the present invention that comprises an elongated armament support plank member representatively carrying, at inboard locations thereon, a multiple tube rocket launcher and a 7.62 mm machine gun.
Figure 2:
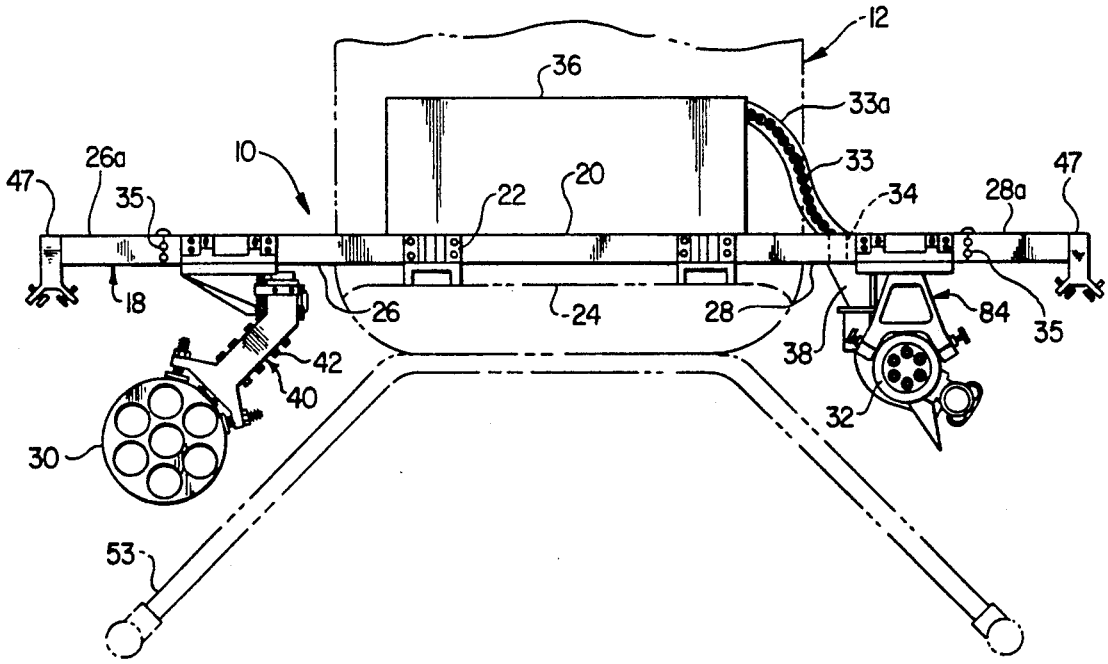
FIG. 2 is an enlarged scale partial cross-sectional view through the helicopter taken along line 2—2 of FIG. 1.

Referring initially to FIGS. 1 and 2, the present invention provides improved armament apparatus 10 which is operatively connected to a representative helicopter 12 having a cockpit area 14 positioned forwardly of a cabin area 16. The armament apparatus 10 includes an elongated metal plank member 18 which is longitudinally extended transversely through cabin area 16, and has a central longitudinal portion 20 with support channels 22 anchored thereto. Support channels 22 are also anchored to the floor 24 of cabin area 16, thus operatively securing armament apparatus 10 to helicopter 12. Outer end portions 26 and 28 of the support plank 18 project outwardly from opposite sides of the helicopter body and have anchored to inboard sections of their lower sides a multiple tube rocket launcher 30 and a 7.62 mm machine gun 32, respectively, as subsequently described.

As will be seen, in conjunction with the plank 18 (further described in copending U.S. application Ser. No. 532,172), the present invention provides weaponry mounting means which are operative to interchangeably mount, in various combinations and relative positional orientations, rocket launchers, 7.62 mm machine guns and .50 caliber machine guns on the plank 18. The rocket launcher/7.62 mm machine gun armament configuration shown in FIGS. 1 and 2 is but one of this variety of possible armament combinations.

The support plank 18 is preferably of a reinforced, rigid "honeycomb" metal construction and has upwardly pivotable outer tip portions $26_a$, $28_a$ which are selectively removable from the balance of the plank by removing retainer pins 35. Formed through outer end portion 28 is a rectangular ammunition belt opening 34 positioned adjacent the nearest side of the helicopter body. Machine gun 32 is supplied with ammunition from an external magazine 36 positioned within cabin area 16 and mounted atop the central portion 20 of the support plank 18. The machine gun ammunition belt 33 is passed outwardly from magazine 36, via a feed chute $33_a$, through suitable openings (not shown) in the helicopter body (or cabin door) and is extended downwardly through opening 34 into receiving chute 38 of machine gun 32.

Figure 4:
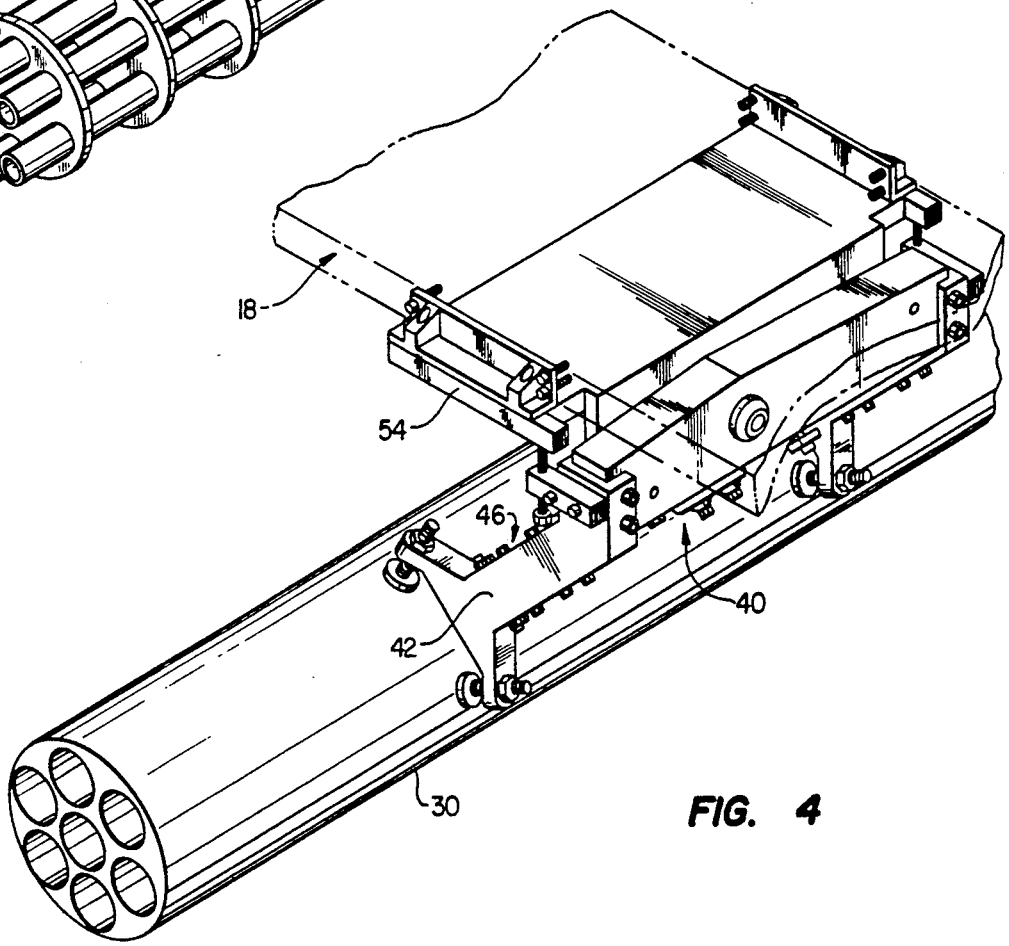
FIG. 4 is an enlarged scale front perspective view of the rocket launcher tube and a specially designed mounting structure which secures it to a portion of the support plank which has been phantomed for illustrative purposes.
Figure 7:
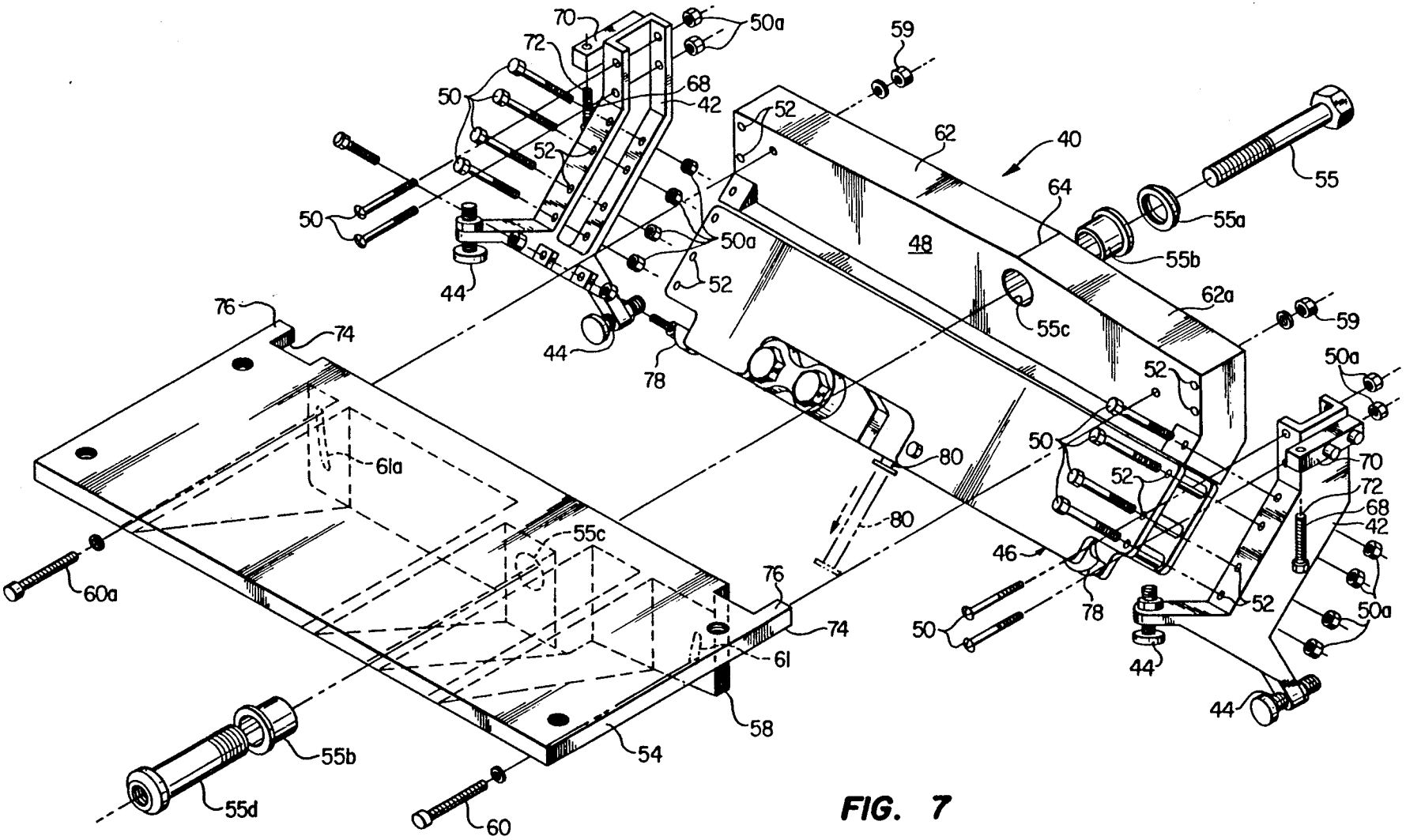
FIG. 7 is an enlarged scale, partially exploded front perspective view of the rocket launcher mounting structure.

Secured to an inboard section of outer plank end portion 26 is a downwardly and outwardly projecting weaponry support structure 40, as shown in FIGS. 2 and 4, and as illustrated in detail in FIG. 7. Referring now to FIG. 7, support structure 40 includes a pair of angled, outwardly projecting support arms 42 which straddle upper surface portions of rocket launcher 30 and are provided with threaded support elements 44 which bear against the launchers. Support arms 42 are secured to the distal ends of a bomb ejector rack 46 and an angled spacer structure 48 by means of bolts 50 extended through aligned holes 52 and threaded into nuts $50_a$. As illustrated in FIG. 2, the support structure 40 holds the rocket launcher 30 over the skid portion 53 of the helicopter.

Angled spacer 48 is adjustably secured to mounting bracket 54 by a bolt 55 extending through a washer $55_a$, a pair of bushings $55_b$, a pair of aligned holes $55_c$, and threaded into an internally threaded stud $55d$, and by bolts 60 and $60_a$ which extend through slots 61 and $61_a$ in vertical wall 58 of mounting bracket 54 and holes 59 in spacer structure 48 and are threaded into nuts 59. Mounting bracket 54 is, in turn, screwed to plank 18 as shown in FIG. 4.

Angled spacer 48 includes two upper surface portions 62 and $62_a$ which meet at an angle at pivot line 64 directly above the aligned holes $55_c$. Support arms 42 are provided with alignment screws 68 which are threaded through blocks 70, such that leading ends 72 bear against lower surfaces 74 of projections 76 extending from the corners of mounting bracket 54. Horizontal alignment of support structure 40 is accomplished by first loosening bolts 60 and $60_a$ and bolt 55, thereby freeing angled spacer 48 to rotate about stud $55_d$, the degree of rotation being generally limited by the movement of screws 60 and $60_a$ within slots 61 and $61_a$. Next, alignment screws 68 are rotated, thereby being extended or retracted as necessary to adjust the vertical alignment of support structure 40. Once the desired alignment is reached, screws 60 and $60_a$ and bolt 55 are tightened, thus preventing accidental movement and subsequent misalignment of support structure 40.

Bomb ejector rack 46 conventionally operates to selectively engage and disengage weaponry, and to forcibly eject said weaponry upon disengagement thereof. Accordingly, bomb ejector rack 46 includes catches 78 and plunger 80, which are explosively activated by electronic control means (not shown). Catches 78 are engageable with mounting eyes (not shown) secured to the exterior of rocket launcher 30 or other desired weaponry. When activated, catches 78 pivot and withdraw to release the mounting eyes on the launcher, thus freeing rocket launcher 30, and plunger 80 extends outwardly to forcibly eject rocket launcher 30, the outward movement of plunger 80 being depicted in phantom in FIG. 7. Due to the unique angle incorporated into weaponry support structure 40, rocket launcher 30 will not, upon ejection thereof, strike the skid 53 or the body of helicopter 12.

Figure 3:
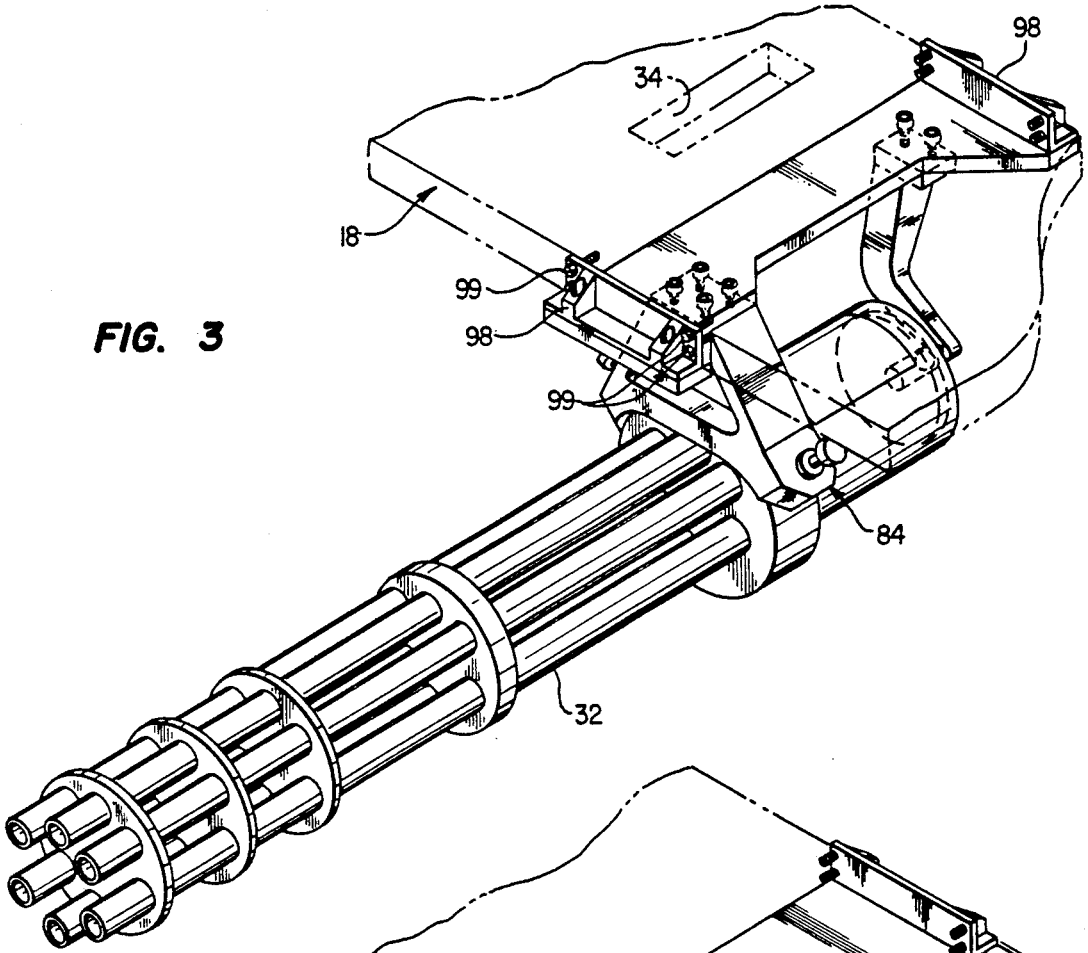
FIG. 3 is an enlarged scale front perspective view of the 7.62 mm machine gun and a specially designed mounting structure which secures it to a portion of the support plank which has been phantomed for illustrative purposes.
Figure 5:
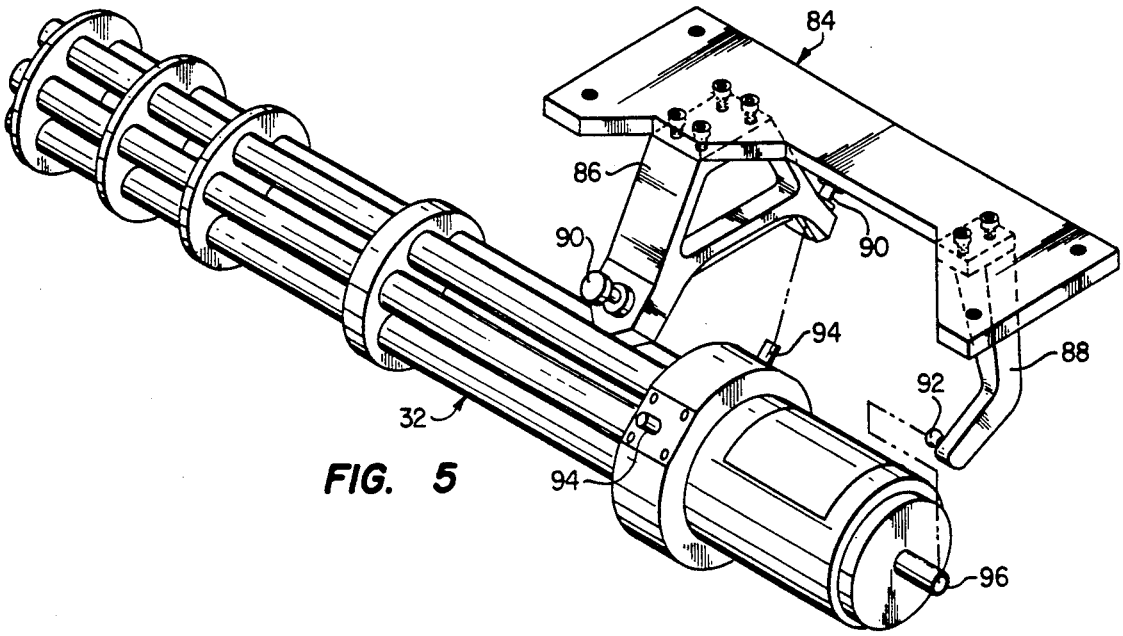
FIG. 5 is a partially exploded rear perspective view of the 7.62 mm machine gun and its associated mounting structure as illustrated in FIG. 3.

Secured to an inboard section of outer plank end portion 28 is a downwardly projecting machine gun support structure 84, as shown in FIGS. 2, 3, 5, and 6. Referring now to FIG. 5, support structure 84 includes front mounting bracket 86 and rear arm 88, which further include fasteners 90 and ball post 92, respectively. Fasteners 90 releasably engage receptacles 94 once ball post 92 is inserted into socket 96, thus releasably securing machine gun 32 to support structure 84. As best illustrated in FIG. 3, support structure 84 is attached to plank 18 by means of angled members 98 and bolts 99.

Figure 6:
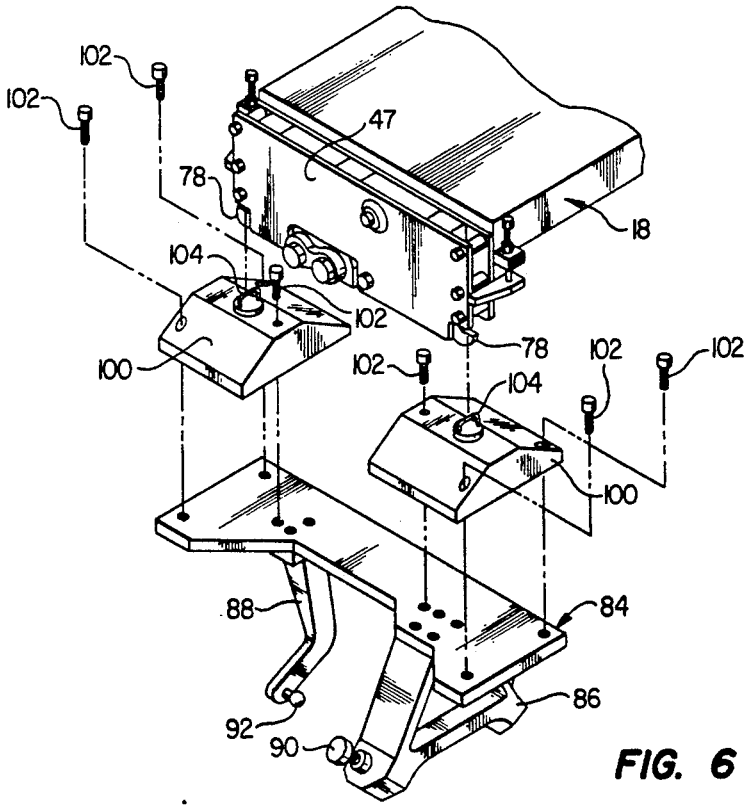
FIG. 6 is a partially exploded front perspective view of an alternate embodiment of the gun mounting structure which permits the 7.62 mm machine gun to be secured to a conventional bomb rack representatively secured to an outer end of the support plank.

As illustrated in FIGS. 1 and 2, in addition to the previously described mounting structures 40 and 84, the weaponry mounting means of the present invention may also include conventional bomb racks 47 secured to the outer tips of the plank 18 as illustrated in FIGS. 1, 2 and 6. These bomb racks 47 may be utilized to secure additional weaponry to the plank 18 beyond the weaponry just described. For example, a 7.62 mm machine gun 32 may be operatively secured to either of the bomb racks 47 by means of bomb lug adapter blocks 100 secured to the upper side surface of the machine gun mounting structure 84 by screws 102 (FIG. 6) and having bomb lugs 104 operatively engaged by the illustrated bomb rack latches 78. Additionally, each of these bomb racks 47 mounted on the tips of the plank 18 may be utilized to support rocket launchers 30 simply by securing the bomb rack latches 78 to the bomb lugs (not shown) on the upper side surface of the particular rocket launcher as representatively illustrated in FIGS. 8 and 9. The illustrated bomb racks 47 are each similar in construction and operation to the bomb rack 40 shown in FIG. 4 of U.S. application Ser. No. 532,172 now U.S. Pat. No. 5,024,138 incorporated by reference herein, and are similarly provided with threaded adjustment members (not illustrated) operative to pivotally adjust the weaponry supported by bomb racks 40 about vertical axes. The weaponry mounting means of the present invention mounting structures 106 (FIG. 8) use to mount .50 caliber machine gun pods 108 on the underside of the plank 18 as illustrated and described in greater detail in copending U.S. application Ser. No. 532,172.

Figure 8:
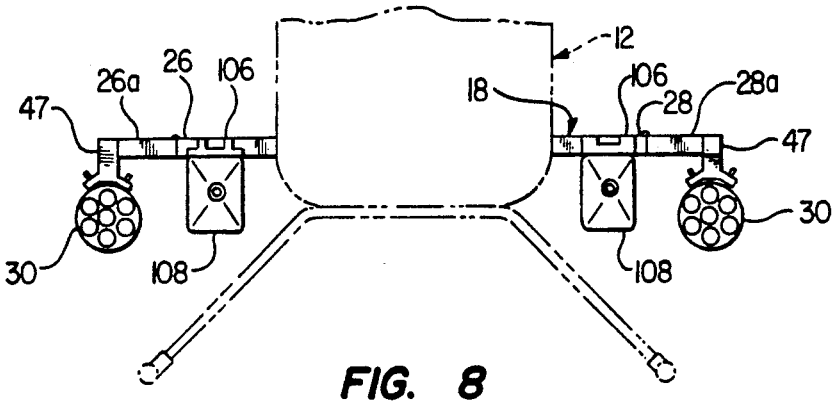
FIGS. 8–11 are reduced scale front elevational views of the helicopter and illustrate four representative alternate weaponry combinations secured to the support plank to partially demonstrate the high degree of armament versatility afforded by the support plank and its associated weapon mounting means.
Figure 9:
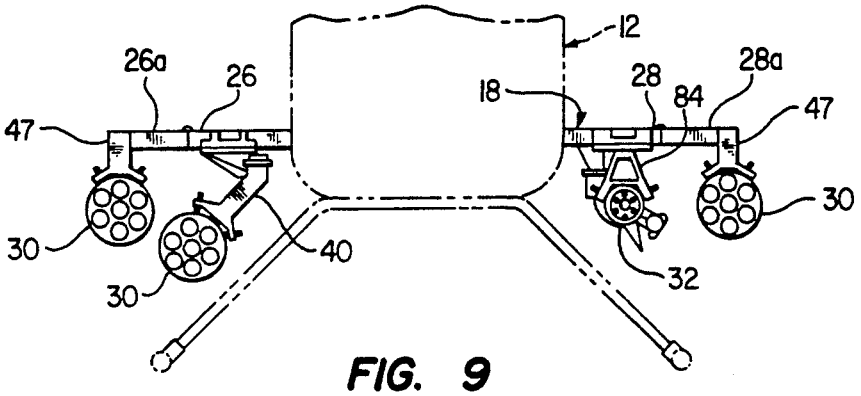
Figure 10:
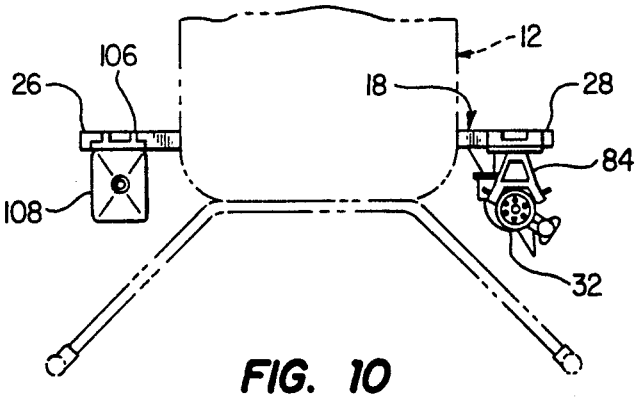
Figure 11:
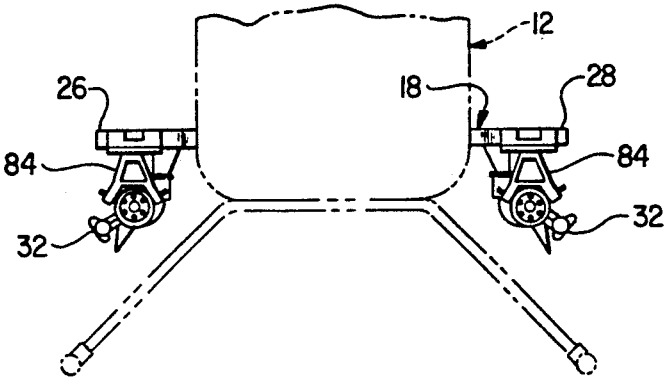

In addition to the plank-mounted weapon combination illustrated in FIGS. 1 and 2, four additional plank-mounted weapon combinations are illustrated in FIGS. 8–11. As will be readily appreciated, these additional four weapon combinations are merely representative of a wide variety of plank-mounted weapon combinations and relative orientations made possible by the overall aircraft armament mounting apparatus of the present invention. For example, FIG. 8 depicts a combination in which two rocket launchers 30 are mounted on the tips of the plank 18, while two .50 caliber machine gun pods 108 are mounted at inboard locations on the outwardly projecting opposite plank portions 26 and 28. In FIG. 9, two rocket launchers 30 are similarly mounted on the tips of the plank, a rocket launcher 30 is mounted by structure 40 on an inboard location of the plank section 26, and a mini machine gun 32 is mounted by structure 84 on an inboard location of the plank section 28. In FIG. 10, the outer plank end portions $26_a$, $28_a$ have been removed, a .50 caliber machine gun pod 108 is mounted on the foreshortened plank section 26, and a 7.62 mm machine gun 32 is mounted on the foreshortened plank section 28. In FIG. 11, the outer plank end portions $26_a$ and $28_a$ have also been removed, and 7.62 mm machine guns 32 have been mounted on each of the foreshortened plank sections 26 and 28.

In summary, utilizing the support plank 18 as a mounting base, the weaponry mounting means of the present invention permits the helicopter 12, or a fixed wing aircraft, to be armed with rocket launchers, 7.62 mm machine guns and .50 caliber machine guns in a wide variety of combinations and positional relationships. Specifically, at each of the two inboard and two outboard plank mounting locations, the weaponry mounting means of the present invention permits four choices—leaving the mounting location vacant, attaching a rocket launcher to the plank, attaching a 7.62 mm machine gun to the plank, or attaching a .50 caliber machine gun to the plank.

The foregoing detailed description is to be clearly understood as being given by way of illustration and example only, the spirit and scope of the present invention being limited solely to the appended claims. It will be apparent to a person skilled in the art that various modifications to the details of construction shown and described may be made without departing from the scope of this invention.

What is claimed is:

1. Armament apparatus for an aircraft having a cabin area, comprising:

an elongated support plank member;

attachment means for securing a longitudinally central portion of said plank member to the aircraft, within said cabin area thereof, in a manner such that opposite outer longitudinal portions of said plank member project outwardly from opposite sides of the aircraft; and weaponry mounting means for removably mounting on said outer longitudinal plank portions selectively variable and oriented weapon combinations selected from the weapon group consisting of rocket launchers, 7.62 mm machine guns and .50 caliber machine guns.

2. The armament apparatus of claim 1 wherein said weaponry mounting means further include:

support means for releasably supporting a rocket launcher, said support means being selectively operable to forcibly eject the rocket launcher therefrom in an ejection direction, and means for securing said support means to the underside of an inboard section of one of said outer longitudinal plank portions in a manner such that said ejection direction is angled downwardly and longitudinally outwardly relative to said one of said outer longitudinal plank portions.

3. The armament apparatus of claim 1 wherein said weaponry mounting means are operative to support a weapon on the underside of an inboard portion of one of said outer longitudinal plank portions.

4. The armament apparatus of claim 1 wherein said weaponry means are operative to support a weapon on the underside of a tip portion of one of said outer longitudinal plank portions.

5. Armament apparatus for an aircraft having a cabin area, comprising:

an elongated support plank member;

means for securing a longitudinally central portion of the plank member to the aircraft, within said cabin area thereof, in a manner such that opposite outer longitudinal portions of said plank member project outwardly from opposite sides of the aircraft;

a pair of support structures secured to and depending from said outer longitudinal portions of said plank member for supporting weaponry, at least one of said support structures including ejection means for selectively ejecting its supported weaponry;

means, associated with said pair of support structures, for pivotally adjusting their supported weaponry about vertical axes generally perpendicular to the support plank member; and means, associated with said support structures, for pivotally adjusting their supported weaponry about axes generally parallel to the longitudinal axis of the plank member.

6. The armament apparatus of claim 5 wherein:

said plank member is of a honeycombed metal construction.

7. The armament apparatus of claim 5 wherein:

the aircraft has a pair of upstanding mounting flanges disposed in said cabin area, and said means for securing said central portion of the plank member include a pair of connecting members secured to the underside of said central plank member portion, and means for anchoring said connecting members to said mounting flanges.

8. The armament apparatus of claim 5 wherein:

said at least one support structure including ejection means is angled downwardly and longitudinally outwardly relative to the support plank member, whereby its supported weaponry may be ejected during flight without striking any portion of the aircraft.

9. Armament apparatus for an aircraft having a cabin area, comprising:

an elongated support plank member;

attachment means for securing a longitudinally central portion of said plank member to the aircraft, within said cabin area thereof, in a manner such that opposite outer longitudinal portions of said plank member project outwardly from opposite sides of the aircraft;

support means for supporting a rocket launcher, said support means being selectively operable to forcibly eject the rocket launcher therefrom in an ejection direction; and means for securing said support means to the underside of one of said outer longitudinal plank portions in a manner such that said ejection direction is angled downwardly and longitudinally outwardly relative to said one of said outer longitudinal plank portions.

* * * * *